United States Patent [19]

Rose

[11] 4,136,268

[45] Jan. 23, 1979

[54] PUSH TO TALK SWITCH

[75] Inventor: William H. Rose, Harrisburg, Pa.

[73] Assignee: AMP Incorporated, Harrisburg, Pa.

[21] Appl. No.: 856,073

[22] Filed: Nov. 30, 1977

[51] Int. Cl.[2] ..... H01H 3/00; H01H 23/24

[52] U.S. Cl. ..... 200/17 R; 200/5 R; 200/6 R; 200/157; 200/339

[58] Field of Search ..... 200/1 R, 1 V, 1 B, 5 R, 200/6 R, 17 R, 18, 61.7 G, 154, 327, 335, 339, 276

[56] References Cited

U.S. PATENT DOCUMENTS 3,784,765 1/1974 Daly ..... 200/5 R

FOREIGN PATENT DOCUMENTS 2,331,065 5/1975 Fed. Rep. of Germany ..... 200/339

*Primary Examiner*—James R. Scott

*Attorney, Agent, or Firm*—Gerald K. Kita

[57] ABSTRACT

The disclosure relates to a manual switch having a lever positioned in opposition to a resilient coiled return spring anchored to a block which includes a projection engaging one of the coils of the return spring and thereby detaining either compaction or expansion of the spring until sufficient pivoting of the lever forces the detained coil to suddenly slidably traverse over the projection of the block to provide an audible noise and a tactile feel indicating sufficient pivoting of the lever.

3 Claims, 6 Drawing Figures

PUSH TO TALK SWITCH

BACKGROUND OF THE INVENTION

Lever actuated push to talk switches are well known in the art as exemplified in U.S. Pat. No. 3,784,765. Such a switch comprises a base with electrical contacts which include electrical terminal portions for connection to external electrical circuits. The switch includes a relatively elongate lever overlying the contacts. The lever is manually depressed in opposition to a return spring thereby connecting two of the contacts together to complete a circuit therebetween. Such a switch is normally mounted to a transceiver allowing signal or voice transmission only while the lever is maintained in a depressed position so as to complete the circuit which enables transmission. When the lever is manually released the coil spring causes return pivotal motion of the lever thereby disconnecting the contacts and thereby disabling the transmission circuit. Such a switch is known in the art as a push to talk (transmit signal) switch. Often the switch is single pole, double throw, such that a receiver circuit is enabled when the transmit circuit is disabled. Conversely, when the lever is pivoted to enable the transmit circuit, the receiver circuit is disabled. One of the long existing needs for such a switch is a tactile feel and an audible indication of sufficient pivotal motion of the lever, to indicate whether the transmit circuit or the receiver circuit is activated.

BRIEF DESCRIPTION

In the present invention, a push to talk switch lever according to the present invention is pivoted in opposition to a coil spring when an operator of the device pushes the lever to enable a transmit circuit. The coil spring is assembled over an anchor block of the switch. The block includes a projecting portion which snags against a coil of the spring when the spring coils are moved together during compaction of the spring coils. The projecting portion snags the coil when the spring coils separate during resilient expansion of the spring. The snagged coil suddenly unsnags during either compaction or expansion of the coil spring to provide a tactile feel and an audible click as an indication of whether the lever is sufficiently pivoted either to activate the transmit or to activate the receiver circuit.

OBJECTS

It is therefore an object of the present invention, to provide a mounting block for a coil spring which snags a portion of the spring to provide a tactile for either compaction or expansion of the spring coils.

Another object of the present invention is to provide an electrical switch actuated by a lever pivoted in opposition to a coil spring, the spring having a coil which is snagged during compaction or expansion of the spring coils to provide a tactile feel and an audible click indicative of the relative position of the switch lever.

BRIEF DESCRIPTION OF THE DRAWINGS

Other objects and advantages of the present invention become apparent from the following detailed description taken in conjunction with the drawings.

FIG. 6 is an enlarged fragmentary elevation in section similar to FIG. 5 illustrating a second pivoted position of the switch lever and compaction of the coil spring, when considered together with FIGS. 3 and 4, illustrating the audible click and tactile feel feature of the switch according to the present invention.

DETAILED DESCRIPTION

Figure 1:
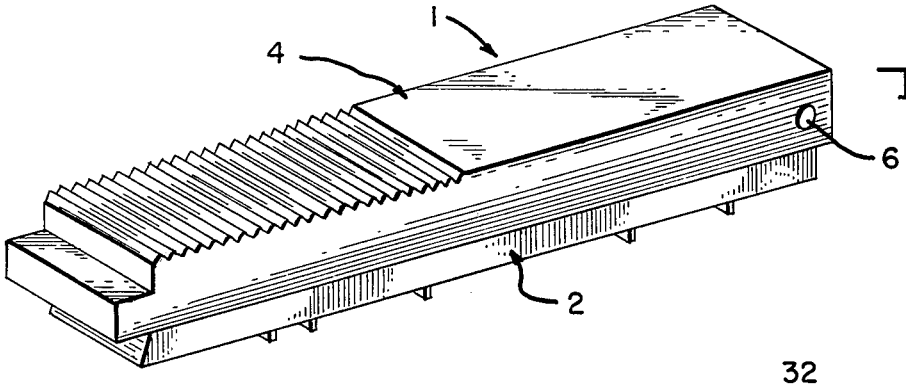
FIG. 1 is an enlarged perspective of a lever actuated switch according to the present invention.
Figure 5:
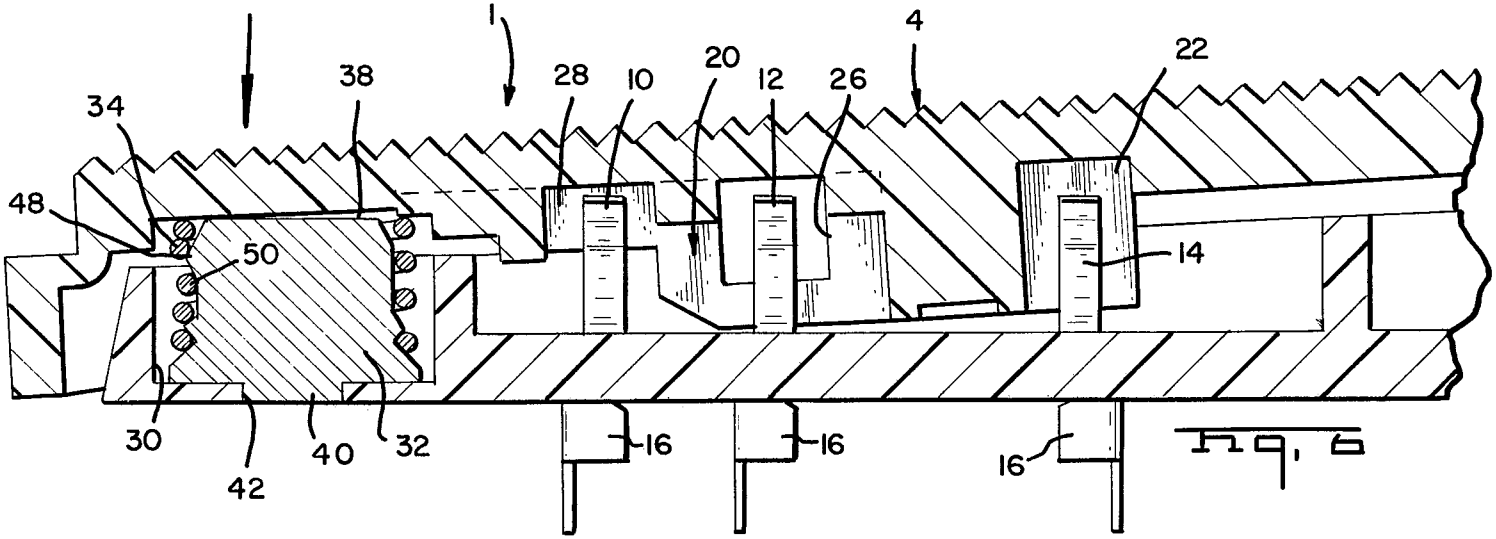
FIG. 5 is an enlarged fragmentary elevation in section of the switch illustrated in FIG. 1 with the coil spring in a fully expanded position and a lever of the switch in a released position.

With more particular reference to FIG. 1 taken in conjunction with FIGS. 5 and 6 a preferred embodiment of a switch according to the present invention is indicated generally at FIG. 1. The switch includes a dielectric base portion 2 and a cover portion 4 which also is a lever. The lever 4 and the base 2 are pivotally connected by a pivot pin 6. The base 2 is molded from a rigid dielectric and is provided with a vertical opening 8 into which are received electrical contacts 10, 12, and 14. Each of the electrical contacts 10, 12, and 14 is in the form of a vertical elongate resilient beam projecting outwardly of a corresponding opening 8. Each of the contacts is provided with a tab terminal portion 16 which vertically depends from the base 2 for pluggable connection to electrical circuits. More specifically, the contact 14 normally is connected by way of the terminal 16 thereof to a ground potential to a reference potential. Contact 12 is connected by its terminal portion 16 to a receiver circuit (not shown). Contact 10 is normally connected by way of its terminal portion 16 to a transmit circuit (not shown). The cover portion 4 or lever is molded from a rigid dielectric and is provided with an inverted cavity 18 having portions of varying depth as shown in the drawings. The cavity 18 partially receives the base 2 therein as shown in FIG. 5. The cavity 18 further is provided with a single metal terminal 20 of plate form metal embedded in or otherwise mounted to the lever 4 by glueing, force-fitting, or any other well known technique. The terminal 20 includes a first vertically elongated contact surface 22 which is slidably engaged by the referenced contact 14. The contact 20 further includes a second contact surface 24 which is slidably engaged by the receiver referenced contact 12, that is, when the lever 4 is in its position shown in FIG. 5. Positioned directly above the contact 12 is a window portion 26 of the terminal for a purpose to be described. The contact 20 includes a third contact surface 28 positioned vertically above the transmit referenced contact 10. In the position of the lever as shown in FIG. 5, the contact 10 is disengaged from the contact surface 28. With the lever thus positioned the contact 20 bridges across the contacts 12 and 14 to complete an electrical circuit therebetween, whereby a receiver circuit is referenced through the switch contacts 12, 20, and 14 to a reference potential or ground whereby the receiver circuit is enabled.

Yet with reference to FIGS. 5 and 6 the base 2 is provided with a recess 30 in which is mounted an anchor block 32 over which is received a resilient coil spring 34. One end 36 of the coil spring is received in the recess 18 and impinges against the under surface of the lever 4. In the position shown in FIG. 5, the coil spring 36 is in a substantially expanded configuration, with the individual coils thereof substantially spread apart from each other. In FIG. 6 the lever 4 is shown pivoted counterclockwise to a position which fully compresses the coils of the spring 34. To prevent excessive pivotal motion, the lever under surface is stopped against a top surface 38 of the block 32. Pivotting of the lever is accomplished by an operator pushing thereon. If the lever is used in a push to talk switch, the contact 12 will disengage from the contact surface 24 and will be disposed within the window portion 26, with the remainder of the contact 12 missing the contact surface 24. In this manner, the electrical circuit will no longer be established from a receiver through the contacts 12, 20, and 14. Thereby the receiver circuit is disabled. Since contact surface 22 is relatively elongated in a vertical direction it remains engaged by the contact 14 referenced to ground or a reference potential. In addition, when the lever 4 is depressed and pivoted to its position shown in FIG. 6 the contact surface 28 will be vertically displaced into engagement with the transmit circuit referenced contact 18, thereby completing an electrical circuit from the transmit circuit through the contacts 10, 20, and 14. Therefore, in a push to talk use of the switch 1, upon pressing the lever 4 and causing counterclockwise rotation thereof a receiver circuit is disabled and a transmit circuit is enabled. The coil spring 34 is compacted with the coils thereof closely adjacent of each other providing resilient stored energy. When the lever 4 is manually released the stored energy causes expansion of the coil spring to return the same to its position shown in FIG. 1. In turn, the lever 4 is pivoted in a clockwise sense to return to its position shown in FIG. 5. Thereby the received circuit is enabled and the transmit circuit is disabled.

Figure 2:
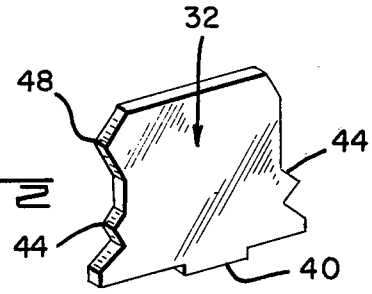
FIG. 2 is an enlarged perspective of a mounting block for a coil spring of the switch shown in FIG. 1.
Figure 3:
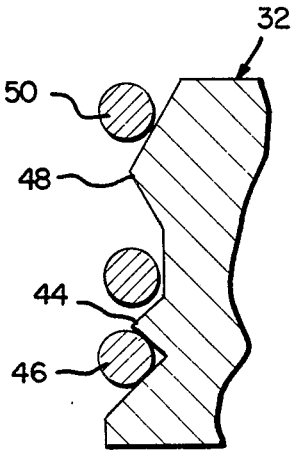
FIG. 3 and FIG. 4 are fragmentary enlarged elevations of the block of FIG. 2 indicating a snagging action of the block on a coil of a coil spring.
Figure 4:
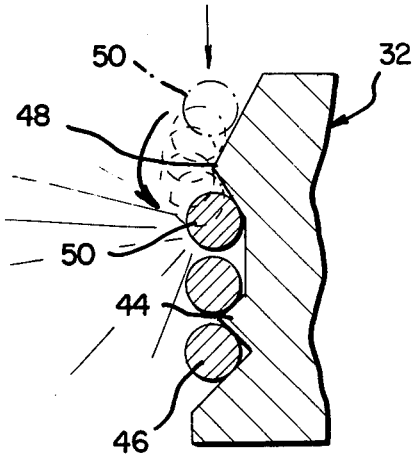
Figure 1:
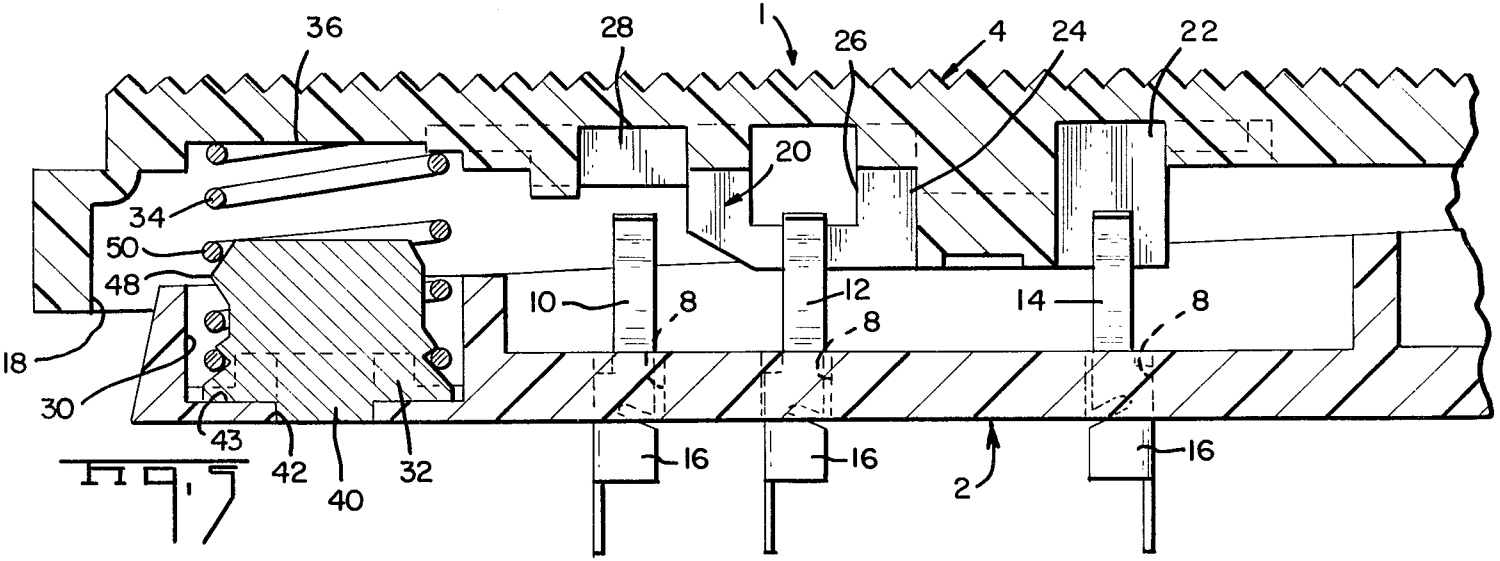

Further details are described in conjunction with FIGS. 2, 3, and 4. The block 32 is shown in FIG. 2 as being of metal plate form having a depending foot 40 which is wedgingly received in a recess 42 of the base 2. The block is provided with a pair of oppositely directed projections 44 which are spaced-apart a distance greater than the diameter of the coil spring 34. When the block 32 is received within the inner diameter of the coils, a lowermost coil 46 is captivated between the projections 44 and a bottom wall 43 of the recess 30. The coil spring thereby is anchored to the block 32 and permanently assembled to the base 2. The block 32 is provided with a projection 48 which projects diametrically beyond the inner diameter of the coil spring 34 mounted over the block 32. A central one of the coils 50 of the spring 34 must slidably traverse over the projection 48 when the spring is either compacted resiliently or expanded resiliently in accordance with the corresponding pivotal motion of the lever 4. As shown in FIG. 5 taken in conjunction with FIG. 3 in the released position of the lever 4 the coil spring 34 is in its expanded configuration with the coil 50 vertically above the projection 48. When the lever is pressed by an operator and pivoted to its position shown in FIG. 6, the coil 50 slidably traverses over the projection 48. More specifically as shown in FIG. 4, the coil 50 moves vertically downward from the position shown in phantom outline to a position vertically below the projection 48. Since the projection 48 laterally projects beyond the inner diameter of the spring, the coil 50 momentarily snags on the projection 48 until sufficient collapse of the spring builds up sufficient resilient spring forces to forcibly traverse the coil 50 slidably over the projection 48. In so doing, the coil 50 suddenly traverses slidably over the projection 48 producing an audible click and a tactile feel to an operator that sufficient pivotal motion of the lever has transpired to perform the enabling and disabling switch operations as described in conjunction with FIG. 6.

Conversely, as the lever 4 is released the spring will expand from its FIG. 6 orientation to the position shown in FIG. 5 causing return pivotal motion of the lever to perform the enabling and disabling switch operations as described in conjunction with FIG. 5. During expansion of the spring 34 the coil 50 will momentarily snag against the undercut vertical portion of the projection 48 until sufficient expansion of the spring has occurred to cause sudden traversal of the coil 48 vertically upward and slidably over the projection 48, whereby the coil 50 returns to its position in FIG. 3 from its position shown FIG. 4. Such sudden traversal of the coil spring over the projection 48 causes an audible click and a tactile feel to indicate that sufficient clockwise pivotal motion of the lever 4 has occurred to perform the switching operations as described in FIG. 5. It is believed that relaxation of the coil spring by expansion thereof is sufficient to pull upwardly on the coil 50 to suddenly unsnag from and traverse over the projection 48.

Although a preferred embodiment of the present invention is described and disclosed in detail, other embodiments and modifications thereof which would be apparent to one having ordinary skill in the art is intended to be covered by the spirit and scope of the appended claims.

What is claimed is:

1. In a switch having a lever pivoted in opposition a coiled resilient return spring, a base carrying a pair of switch poles, and a bridging contact moved by sufficient pivoting of said lever to engage said poles and establish electrical connection therewith, the improvement comprising:

means anchoring said return spring to said base, means for engaging a coil of said spring thereby detaining compression of at least a portion of said spring until said sufficient pivoting of said lever has occurred to resiliently compress a remainder of said coil spring to cause sudden slidable traverse of said coil over said last mentioned means, said sudden traverse providing an audible click and a tactile feel of said sufficient pivoting of said lever, and a stop engaged by said lever to prevent excessive pivoting thereof.

2. The structure as described in claim 1, wherein said improvement further includes:

said return spring being expanded to provide return pivoting of said lever and said last-mentioned means further detaining said coil upon expansion of said return spring until sufficient expansion of said coil spring causes sudden slidable traverse of said coil over said last-mentioned means which produces an audible click and an tactile feel of said return pivoting of said lever.

3. The structure as recited in claim 1, wherein said improvement further comprises:

an anchor block comprising said means anchoring said return spring to said base, and said last mentioned means comprising a projection snaggingly engaging said coil of said spring.

* * * * *